United States Patent [19]

Lipp et al.

[11] 4,198,897

[45] Apr. 22, 1980

[54] TANK MORTAR

[75] Inventors: Herbert Lipp; Wilfried Becker, both of Dusseldorf, Fed. Rep. of Germany

[73] Assignee: Rheinmetall GmbH, Dusseldorf, Fed. Rep. of Germany

[21] Appl. No.: 939,227

[22] Filed: Sep. 5, 1978

[30] Foreign Application Priority Data

Sep. 10, 1977 [DE] Fed. Rep. of Germany ..... 2740895

[51] Int. Cl.[2] ..... F41F 9/06

[52] U.S. Cl. ..... 89/13 R; 89/37 C

[58] Field of Search ..... 89/1 F, 1 J, 1, 804, 89/13 R, 17, 33 MC, 37 C, 40 A

[56] References Cited

U.S. PATENT DOCUMENTS 2,380,024 7/1945 Chandler ..... 89/13 R

*Primary Examiner*—Stephen C. Bentley

*Attorney, Agent, or Firm*—Montague & Ross

[57] ABSTRACT

A tank mortar having a magazine receiving a plurality of fin-stabilized projectiles which can be selectively aligned with the barrel. The barrel is movable relative to the magazine to enable sealing engagement of the barrel with the selected magazine chamber. The weapon frame which rotatably receives the magazine has an upper portion in which the bottom of the barrel is axially shiftable, e.g. by a bayonet arrangement, and a lower portion which sealingly engages the bottom of the munition chamber which is aligned with the barrel includes the firing element which triggers the displacement of the projective from the round chamber through the barrel. The base of the weapon frame is also provided with a ball received in a socket which is shiftable to traverse the weapon.

9 Claims, 8 Drawing Figures

FIG. 1
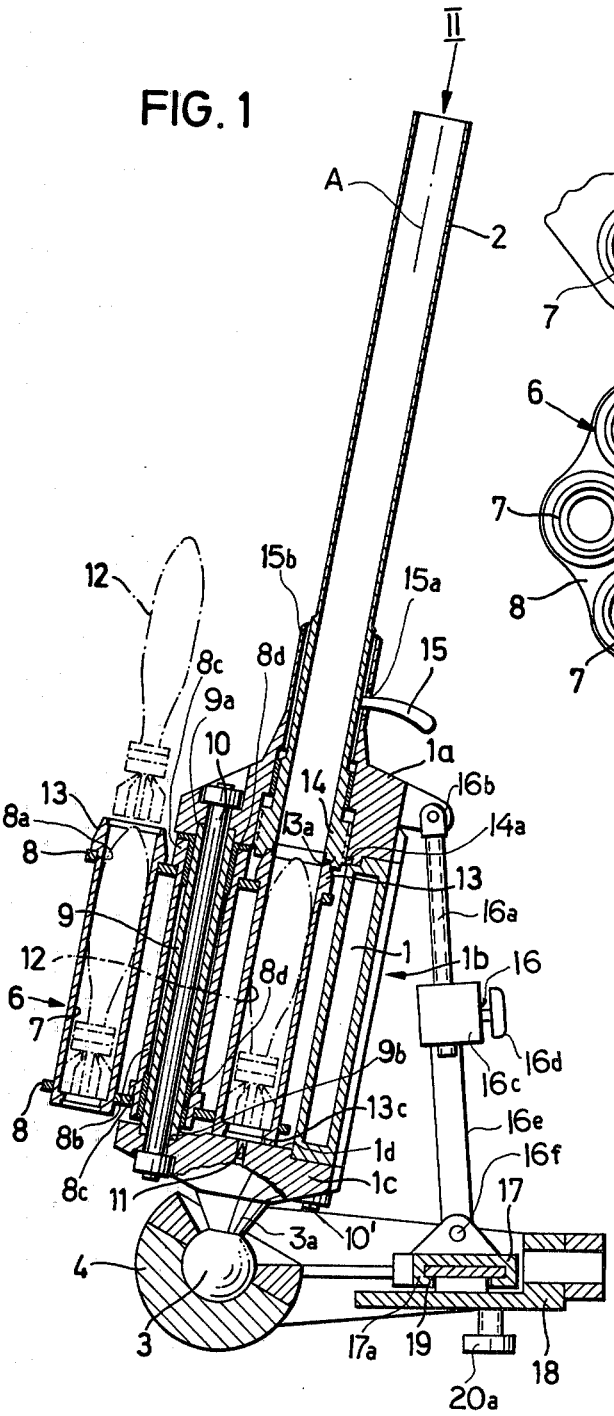
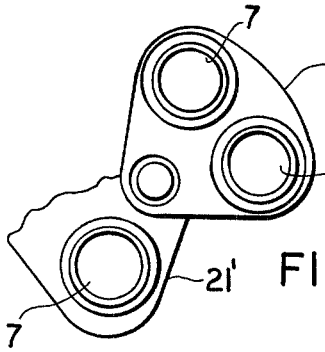
FIG. 8
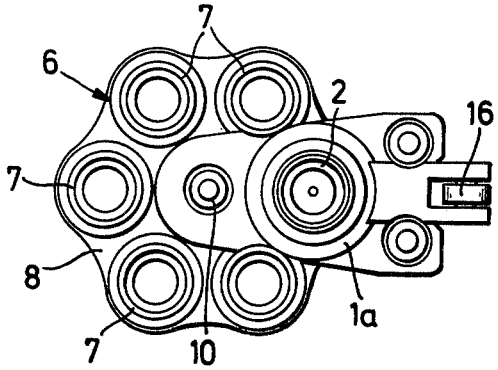
FIG. 2
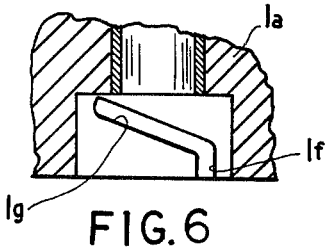
FIG. 6
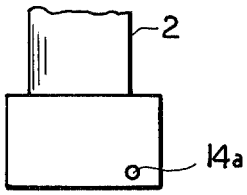
FIG. 7

TANK MORTAR

FIELD OF THE INVENTION

The present invention relates to a tank mortar having a magazine for a plurality of fin-stabilized rounds and, more particularly to a highly compact mortar-type weapon particularly adapted for mounting in an armored vehicle such as a tank.

BACKGROUND OF THE INVENTION

Weapons with magazines of the turret-type have been provided heretofore in a variety of configurations, the most well known of which is the hand-held revolver. In this type of weapon, the magazine is capable of receiving a plurality of rounds in a drum which is rotatable to successively align the round-receiving chambers with a barrel. In such systems, each chamber forms the firing chamber of the weapon in succession and the round can consist of a casing or shell from which the bullet or slug is ejected by the firing of a charge behind the bullet. The shell remains in the chamber and is moved out of alignment with the barrel as the next round is aligned therewith.

Such systems are also known in hand-held rifle configurations and mention may also be made of drum-type automatic weapons in which the cartridges are displaced by a drum past the barrel at a high rate. In the latter configuration, the shells may be ejected from the weapon.

None of these systems have been found to be practical for fin-stabilized projectiles of for field weapons such as artillery.

However, the German open application, (Offenlegungsschrift) DT-OS No. 15 78 170 describes a magazine and a loading device for a field grenade thrower in which six rounds may be received in a drum-type magazine which is so constructed and arranged that the drum carries the round into alignment with the discharging tube and is advanced into the latter by an ejector. From the magazine tube, the round is carried by a transport chain into the weapon barrel which can be swung from a recumbent position for leading into an inclined position for firing.

The spatial requirements of such a system are such that the assembly cannot readily be carried by an armored vehicle or used as a tank mortar in mobile field artillery.

It should also be noted that this system and the earlier magazine weapon systems described above do not encounter the problem involved in the provisions of a magazine for the firing of rounds in a gas-type connection between the magazine and the barrel.

Such problems arise in mortar configurations of field artillery if fin-stabilized projectiles are to be fired through the barrel.

In German patents DT-PS Nos. 1 151 451 and 1 219 828, for example, there are disclosed conventional gas-type barrel closures which require transversely subdivided barrels with swingable barrel halves to accomplish a gas-type connection with the round-receiving chamber so as to create a gas-tight communication between the round-receiving chamber and the barrel.

Thus, it can be stated that, in general, the problem of providing a tank-type mortar which is capable of being mounted on an armored vehicle, or, more particularly, on a readily movable or self-propelled platform and can be provided with a magazine for the successive firing of a plurality of rounds has not been solved heretofore.

OBJECT OF THE INVENTION

It is the principal object of the present invention to provide a weapon which can be used as a tank mortar, overcomes the disadvantages of the earlier systems, has limited dimensions so as to be capable of mounting on a self-propelled weapons platform, is composed of simple and few parts, enables rapid firing of a number of projectiles and can be used with various types of magazines which are replaceable in the weapon frame.

SUMMARY OF THE INVENTION

This object and other which will become more readily apparent hereinafter are attained in accordance with the present invention in a weapon, generally a mortar, which can be used as a tank mortar and which comprises a gun frame in whose upper portion or head the barrel of the mortar is longitudinally shiftable and can be arrested while an intermediate parts of this frame serves to receive a drum-type or swingable magazine which can be releasably mounted on an axle parallel to the axis of the barrel so as to enable replacement and interchange of magazines, the axle bridging the head and bottom of the frame, and at least two munitions or round chambers formed in the magazine and successively alignable with the barrel in selective angular positions of the magazine. The base of the frame can also include a detonator for the fin-stabilized rounds which are aligned with the detonator and the barrel when the respective chamber is swung into the firing position.

According to the invention, therefore, the barrel is, by axial displacement, brought into sealing engagement with the chamber aligned with the barrel and into sealing engagement with the bottom or base of the frame around the detonator for each firing operation, the barrel being axially displaced, e.g. on a bayonet, cam or like connection to release the magazine and enable another chamber to be aligned with the barrel.

Naturally, at least two chambers are required, one of which is accessible externally of the frame to permit replacement of a round therein while the round in the chamber aligned with the barrel is being fired. Where more chambers are provided, advantageously in angularly equispaced relationship in a drum-type or turret-type magazine, the speed of firing is increased.

According to an essential feature of the invention, the base of the frame is provided in axial alignment with the barrel and the detonator, with a ball which is received in a ball carriage so as to swingably support the frame, the barrel and the magazine so as to enable the elevation of the barrel to be adjusted and to facilitate traversing of the weapon and inclination thereof in two mutually perpendicular planes containing the barrel axis.

According to yet another feature of the invention, the barrel and the head of the frame form a bayonet connection which enables axial displacement of the barrel in the head of the frame by slight angular displacement of the barrel to lock the barrel against the round chamber aligned therewith and containing a fin-stabilized projectile to be fired.

According to this aspect of the invention, each round chamber of the magazine at its bottom surface and juxtaposed surface of the base of the gun frame are provided with mutually engaging sealing means to provide a gas-type seal between the round chamber and the base while the upper surface of the magazine and the lower surface of the head of the frame are provided with complementary and mutually engageable sealing means also forming a gas-type connection between the round chamber and the barrel.

In one embodiment of the present invention, the magazine is provided with two adjacent munitions or round chambers and is simply swingable about the axis of the axle previously mentioned. A plurality of such swingable magazines, each of which can form approximately a segment of a cylinder, can be assembled to provide a multichamber magazine which can be completed into a drum if desired.

Naturally, within the context of the present invention, the magazine can have any number of chambers, depending upon the distance between the axis of the drum and the axis of the barrel and the diameter of the chambers. It is only essential for the purposes of the present invention that at least two chambers be provided.

The weapon of the present invention is extremely compact and is particularly adapted for use as a tank mortar since it can be accommodated within the interior of the armored shell of a tank-type vehicle.

BRIEF DESCRIPTION OF THE DRAWING

The above and other objects, features and advantages of the present invention will become more readily apparent from the following description, reference being made to the accompanying drawing in which:

FIG. 1 is an axial cross-sectional view through a tank mortar according to the present invention, shown in part diagrammatically;

FIG. 2 is a view in the direction of the arrow II of the tank mortar of FIG. 1;

FIG. 6 is an axial cross-sectional detail view showing a portion of the bayonet connection between the barrel and the head of the gun frame;

FIG. 7 is an elevational view showing the cooperating element of the bayonet connection on the barrel; and FIG. 8 is a view illustrating the assembly of a plurality of swingable magazines into a multi-round magazine.

SPECIFIC DESCRIPTION

Figure 3:
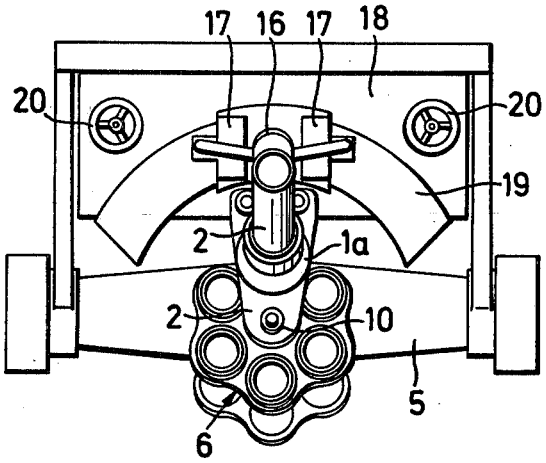
FIG. 3 is a plan view of the tank mortar showing the elevation, traversing and leveling means for the mortar of FIGS. 1 and 2.

The tank mortar illustrated in FIGS. 1 through 3 comprises a gun frame which has generally been represented at 1 and which consists of a head 1*a*, an intermediate portion formed by beams 1*b* and a base 1*c*. The assembly 1*a*–1*c* is held together by tie-bolts 10, 10' of which the tie-bolt 10 constitutes an axle as will be described presently and a drum-type magazine.

The base 1*c* is formed along its underside with a downwardly extending neck 3*a* carrying a ball 3 in axial alignment with a detonator 11 of conventional design. The detonator 11 is, of course, provided along the surface 1*a* of the base 1*c* confronting the barrel 2 of the weapon.

The ball 3 is received in a ball socket 4 which is displaceable in a traverse 5 best seen in FIG. 3. In other words, the socket 4 is shiftable on the traverse 5 to swing the barrel 2 of the weapon in a plane of the axis A of the barrel perpendicular to the plane of the paper in FIG. 1.

The intermediate member 1*b* of the frame comprises, in turn, a plurality of beams which are traversed by the tie-bolts 10, 10' and space the members 1*a*, 1*b* apart, the magazine 6 being received between such beams.

The drum-type magazine of FIGS. 1 through 3 comprises a plurality of cylindrical round chambers 7 each of which is formed as a tube and is anchored in the bores 8*a* of a pair of disks 8. The disks 8 are, in turn, rigid with a sleeve 8*b* provided with shoulders 8*c* holding the disks apart. The sleeve 8*b* is, in turn, affixed by bushings 8*d* to a tube 9 forming a hub for the magazine, the hub journaling the magazine on the tie-bolt 10. The upper and lower ends of the hub can be received in recess 9*a* and 9*b* of the head 1*a* and the base 1*c* of the gun frame, respectively.

The drum 6 is provided with cylindrical round chamber 7 in the manner described, each round chamber being welded externally to the disks 8.

The successive round chambers 7 are brought stepwise into alignment with the barrel by automatic means not shown but conventional in the art of drum-type magazines advanced for hand weapons, for instance, or manually by the weapons operator. Thus each chamber 7 is brought in turn into axial alignment with both the barrel and the detonator 11 so that its fin-stabilized projectile 12 can be fired from the barrel.

To create a gas-tight connection between the chamber and the detonator and between the chamber and the barrel, sealing means is provided. As is apparent from FIG. 1, the sealing means include an upwardly tapered mouth 13 on the upper projected end of the tube forming each round chamber and which is received in a downwardly diverging frustoconical mouth 13*a* of the lower end of the ball too.

Similarly, the upper surface 1*d* of the base 1*c* of the gun frame can sealingly engage the lower end 13*c* of the round tube of the chamber aligned with the barrel. Elements 13, 13*a* and 13*c* thus form sealing means of the type described.

To enable the chambers to be emplaced in alignment with the barrel, the barrel 2 is constructed and arranged to be somewhat raised from the magazine, thereby enabling each tube 7 to be swung out of alignment and the next tube to be swung into alignment with the barrel. The barrel 2 is connected at its lower portion with the head 1*a* of the weapon frame by a bayonet connection 14 which accomplishes this axial displacement upon a slight angular displacement of the barrel by means of an actuating lever 15 connected to the barrel and projecting through a lateral opening 15*a* in a sleeve 15*b* of the head 1*a* coaxially surrounding the barrel.

The bayonet connection has been shown in somewhat greater detail in FIGS. 6 and 7.

As can be seen from FIG. 7, the barrel 2 may be provided with a lateral pin 14*a* which can engage in a slot 1*f* which extends along the interior of the head 1*a* so that upon rotation of the barrel, the latter will rise and clear the magazine tube 7 previously in alignment with the barrel. Naturally, when the barrel is rotated in the opposite sense, a sealing connection between the magazine and the base 1*c* and between the magazine tube and the barrel is created to allow propulsion of the thin-stabilized projectile from the weapon.

The actuating lever 15 can be coupled to a servomechanism so that only a minimum force is required on the part of the operator to displace the barrel.

The elevation control comprises a threaded spindle 16*a* which is articulated to a lug 16*b* on the head 1*a* and extends through a block 16*c* containing a nut which can be driven by a worm gear rotated by a handwheel 16*d*. Upon rotation of the handwheel 16*d* of the elevation-setting device, therefore, the tilt of the barrel 1 is adjusted. The block 16*a* is carried by a bar 16*e* which is articulated to a lug 16*f* rising from a plate 17*a* of the traversing mechanism. The plate 17*a* of the traverse mechanism 17, forms part of a carriage best seen in FIG. 3 which is shiftable along an arcuate plate 19 forming a guide rail. The center of curvature of this guide rail coincides with the center of the ball 3 and the socket 4. Thus, by displacement of the carriage 17, 17*a* along the guide rail 19, the direction in which the barrel is turned can be varied.

The guide rail 19 is mounted on the plate 18 constituting the base plate of the weapon. The latter is supported on pedestals 20*a* which are in the form of spindles rotatable by handwheels 20 to adjust the tilt of the plate 18 and hence serve as leveling adjustments.

Figure 5:
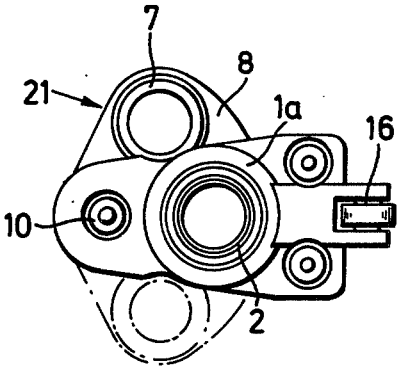
FIG. 5 is a view taken in the direction of the arrow V of FIG. 4.
Figure 4:
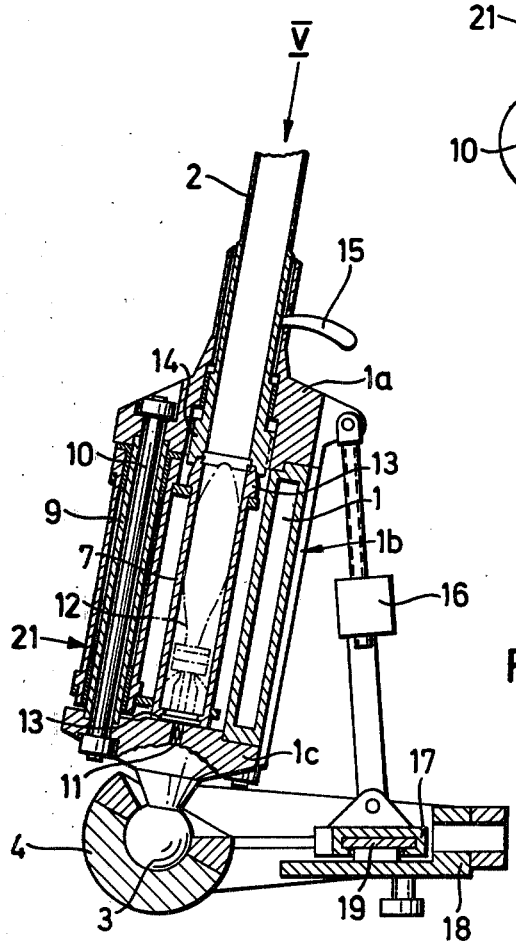
FIG. 4 is a fragmentary longitudinal cross section through a mortar using a swingable magazine as distinct from the drum magazine of FIGS. 1 through 3.

As can be seen from FIGS. 4 and 5, in place of the drum magazine (FIGS. 1 through 3) with six munitions chambers 7, a swingable magazine 21 with two munitions chambers 7 can be provided. Naturally, the swingable magazine can be formed with a greater number of munitions chambers, e.g. three.

The swingable magazine 21, which has the configuration of a sector of the drum magazine, is also angularly displaceable about the axle 10 which is removable as previously mentioned via its hub 9 to enable ready replacement of the magazine by a magazine of the other type, the munitions chambers 7 being alternately aligned with the barrel and swung out of the frame, e.g. as shown by dot-dash lines, to permit loading with a new fin-stabilized projectile. The projectiles are inserted as diagrammatically shown in FIG. 1, from above.

A plurality of the swingable magazine 21 can be jointed together to form a drum magazine or an assembly of magazine sectors as shown in FIG. 8 in which two such sectoral magazines 21 and 21' are provided. Naturally, when three such sectoral magazines are used, the magazine has the configuration of a complete drum.

We claim:

1. A mortar, especially for an armored vehicle, comprising:

a base formed with a ball socket;

a gun frame comprising a head at an upper portion of said frame, a bottom at a lower portion of said frame, and beams interconnecting said head and said body, and a ball mounted on said bottom and rotatably received in said socket;

a barrel axially shiftable in said head and disposed such that the center of said ball lies substantially along said axis;

a magazine formed with a plurality of angularly spaced mutually parallel munitions chambers for respective rounds of fin-stabilized projectiles;

means including a removable axle and replaceably mounting said magazines on said frame for angular displacement about an axis offset from the axis of said barrel but parallel thereto and parallel to the respective munitions chambers whereby said chambers are successively aligned with said barrel and are disposed between said head and said bottom of said frame;

a detonator on said bottom alignable with each chamber upon the positioning thereof in alignment with said barrel to fire the respective round; and elevation and traverse adjusting means between said base and said frame for setting the inclination and direction of said barrel.

2. The mortar defined in claim 1, further comprising a bayonet connection between said barrel and said head for axially shifting said barrel on said head relative to a chamber aligned therewith upon rotation of said barrel, said barrel and each chamber aligned therewith and said magazine and said bottom being formed with sealing means for the gas-tight sealing of each chamber upon axial displacement of said barrel thereagainst.

3. The mortar defined in claim 2 wherein said magazine has the configuration of a drum sector with two munitions chambers and is swingable about the axis of said magazine.

4. The mortar defined in claim 2 wherein said magazine is a drum provided with a multiplicity of munitions chambers.

5. The mortar defined in claim 4 wherein said drum is formed from a plurality of drum sectors each having two munitions chambers.

6. The mortar defined in claim 2 wherein said magazine comprises at least two chamber tubes each received in respective bores of a pair of spaced apart disks, each of said tubes having a tapered upper end forming part of said sealing means.

7. The mortar defined in claim 6, further comprising leveling means on said base for adjusting the inclination thereof.

8. The mortar defined in claim 7 wherein said base is formed with an arcuate rail, said adjusting means comprising a carriage displaceable along said rail, and at least one bar articulated to said carriage and hinged to said head, said bar being provided with means for adjusting the effective length thereof.

9. The mortar defined in claim 8 wherein said head has a sleeve portion surrounding said barrel and said barrel is provided with a laterally extending handle projecting through said sleeve portion.

* * * * *